United States Patent [19]

Pav

[11] 4,073,444

[45] Feb. 14, 1978

[54] CUTTING MILL

[75] Inventor: Jarmil Pav, Reutlingen, Germany

[73] Assignee: Bruderhaus Maschinen GmbH, Reutlingen, Germany

[21] Appl. No.: 728,116

[22] Filed: Sept. 30, 1976

[30] Foreign Application Priority Data

Oct. 4, 1975 Germany ..... 2544496

[51] Int. Cl.[2] ..... B02C 18/22

[52] U.S. Cl. ..... 241/73; 241/241; 241/285 B

[58] Field of Search ..... 241/73, 221, 239, 240, 241/241, 242, 285 A, 285 B

[56] References Cited

U.S. PATENT DOCUMENTS

| | | | |
|---|---|---|---|
| 2,216,612 | 10/1940 | Dimm et al. | 241/73 X |
| 3,342,231 | 9/1967 | Waldrop | 241/241 X |
| 3,419,223 | 12/1968 | Morin | 241/285 B UX |
| 3,829,030 | 8/1974 | Wallenfang et al. | 241/73 X |

FOREIGN PATENT DOCUMENTS

| | | | |
|---|---|---|---|
| 2,019,384 | 11/1971 | Germany | 241/285 A |
| 1,380,922 | 1/1975 | United Kingdom | 241/73 |

*Primary Examiner*—Joseph H. McGlynn
*Assistant Examiner*—Howard N. Goldberg
*Attorney, Agent, or Firm*—Wigman & Cohen

[57] ABSTRACT

A cutting mill for comminuting or fragmenting solid material and separating the same according to particle size is disclosed. The cutting mill comprises a housing having an upper pivotable part and a lower part, a bladed rotor rotatably mounted in the upper part and stator blades mounted in the upper part for cooperation with the rotor blades. The lower part has an opening covered by an easily replaceable sieve through which particles of a predetermined size are discharged. The particle size is determined by the spacing between the sieve and rotor blades, which spacing is determined by spacing elements mounted concentrically of the rotor at the ends thereof. The spacing elements are also provided with surfaces for setting a predetermined spacing between the rotor and stator blades.

7 Claims, 4 Drawing Figures

CUTTING MILL

BACKGROUND OF THE INVENTION

The present invention relates to a cutting mill having a horizontally positioned rotor carrying cutting tools. The rotor is positioned in a housing which consists of an upper part and a lower part and which forms a cutting chamber. The housing carries stator cutting tools which interact with the cutting tools of the rotor. The upper part of the housing is hingedly connected with the lower part about an axis parallel to the axis of the rotor. A replaceable sieve is removably located in the lower part of the housing.

In reconditioning processes, cutting mills are used for the purpose of fragmenting solid matter to yield a particle size and particle form necessary for further processing. By means of such cutting mills, primarily manufacturing scraps, residues, damaged new products and by-products, such as for example, synthetics, leather, wood for fragmented into granulated material or particles similar to granulated material for the purpose of reuse. Moreover, the cutting mill not only carries out fragmentation, but also separates the resulting particles according to size.

The replacement of the parts of the cutting mill which are subject to wear and the preparation necessary for changing over to other materials or other particles is, in the case of known cutting mills of the above mentioned type, relatively time consuming. In addition, the replacement of the sieve is relatively troublesome. In the case of large cutting mills, there is also a certain danger of injuries to the operating personnel. When the sieve requires replacement, it must be pulled outwardly from the lower part of the housing in the peripheral direction of the rotor portion which is located in the lower part of the housing, and must be reinserted in the opposite direction. In addition, the cutting chamber in the region of the sieve is not readily accessible, so that, in the case of the processing of certain materials or during the changeover to another material, the necessary cleaning of the cutting chamber is rendered more difficult.

In the case of known cutting mills, a precise adjustment of the cutting tools, particularly a precise adjustment of the gap between the cutting tools carried by the rotor and the sieve is accomplished at relatively large expense. In many cases, therefore, the cutting mill is not operated with correctly adjusted tools, either because the operator does not undertake the effort to obtain a correct adjustment, or because he is unable to carry out a precise adjustment. The consequence of an inexact adjustment is that the particles do not have the desired size, shape and/or surface structure and also that energy consumption is larger than in the case of correctly adjusted tools. The greater energy requirement not only increases the cost of the operation, but also frequently results in an undesirable development of heat in the cutting mill which may cause an impairment of the characteristics of the obtained particles.

SUMMARY AND OBJECTS OF THE INVENTION

An object of the invention is to provide a cutting mill in which the necessary changes, preparations and operations can be carried out easily, rapidly and without the danger of injury to operating personnel. According to the invention, this object is accomplished in a cutting mill, in one aspect, by the fact that the rotor is mounted in the upper part of the housing. This arrangement of the rotor in the upper part of the housing results in the fact that when the upper housing part is swung open, the rotor is removed from the lower housing part. This makes the sieve freely accessible in the lower part for replacement or cleaning and is, therefore, more easily accomplished in a significantly shorter time than in the case of known cutting mills. Also, there is no danger that an operator may injure himself in the replacement or cleaning process. After the sieve has been removed, the cutting chamber is also readily accessible and may also be easily cleaned quickly and without danger of injury.

In order to obtain, in a simple manner, the correct size of the gap between the blades of the tools carried by the rotor and the surface of the sieve, spacing elements are provided, in the case of the preferred construction, which, like the rotor, are mounted in the upper part of the housing and each of which is provided with a contact surface for the sieve. The contact surfaces of the spacing elements are coaxial to the axis of rotation of the rotor and, according to the desired gap between the cutting tools of the rotor and the sieve, extend beyond the circumference of flight of the blades of the cutting tools. The correct gap between the sieve and the cutting tools of the rotor is, therefore, adjusted automatically when the rotor and the spacing elements are swung together into the lower part of the housing. Adjusting operations are thus completely unnecessary, which not only results in the saving of time but also requires less knowledge and reliability on the part of the operator.

For manufacturing reasons, it is preferred to construct the spacing elements as plates with cylindrical surfaces, comprising contact surfaces for the sieve.

Preferably, one of the spacing elements is located adjacent each end of the rotor and is at least indirectly connected to the rotor. This connection with the rotor, which may be, for example, constructed in such a way that the spacing element is located on an outside positioning ring or on a seat of the upper part of the housing which is concentric to it, insures the correct position of the contact surfaces for the sieve in relation to the axis of rotation of the rotor and irrespective of the tolerances of the other parts of the housing, for example, the hinges which connect the upper housing part with the lower housing part or of the contacting surfaces of the two housing parts. The arrangement of one spacing element adjacent each end of the rotor results in an accurate positioning of the sieve. In addition, these spacing elements may be utilized as lateral limiting walls of the cutting chamber.

If a positioning at other points, for example, at the mid-point of the cutting mill, is desired, which may be the case in cutting mills with a relatively long rotor, in order to insure that the gap remains the same between the sieve and the blades of the cutting tools carried by the rotor over the entire length thereof, at least one spacing element may be mounted on the rotor or rotor shaft between the two spacing elements arranged adjacent the ends of the rotor.

In the case of a preferred construction, bearing surfaces for the sieve are provided in the lower part of the housing which are aligned with the contact surfaces of the spacing elements. In this case, the sieve is clamped between the spacing elements and the bearing surfaces of the lower part of the housing, which provides an extremely simple solution for fastening the sieve and also results in the capability of rapidly replacing the sieve.

In order to be able to exchange the cutting tools of the rotor as rapidly as possible and so that, after mounting the blades at the rotor, no further adjustments are necessary, the blades are, in a known manner, adjusted before their installation into the rotor by means of adjusting plates. In order to simplify the adjustment of the stator cutting tools, at least two of the spacing elements have an adjusting device for the stator cutting tools comprising a stop face for the stator cutting tools which face is concentric to the axis of rotation of the rotor. The cutting tools, therefore, need only be brought into contact with the stop face and secured in position. Measuring devices, and the like are, therefore, not required for the stator blade adjustment which can be carried out even by inexperienced personnel quickly and without difficulty.

The stop face or surface may, for example, be formed by the surface of a ring or by a step in the surface of each plate which forms a spacing element. This is particularly advantageous with regard to manufacturing costs.

BRIEF DESCRIPTION OF THE DRAWINGS

In the following, the invention is further explained by means of an embodiment shown in the drawing wherein.

DETAILED DESCRIPTION OF A PREFERRED EMBODIMENT

Figure 1:
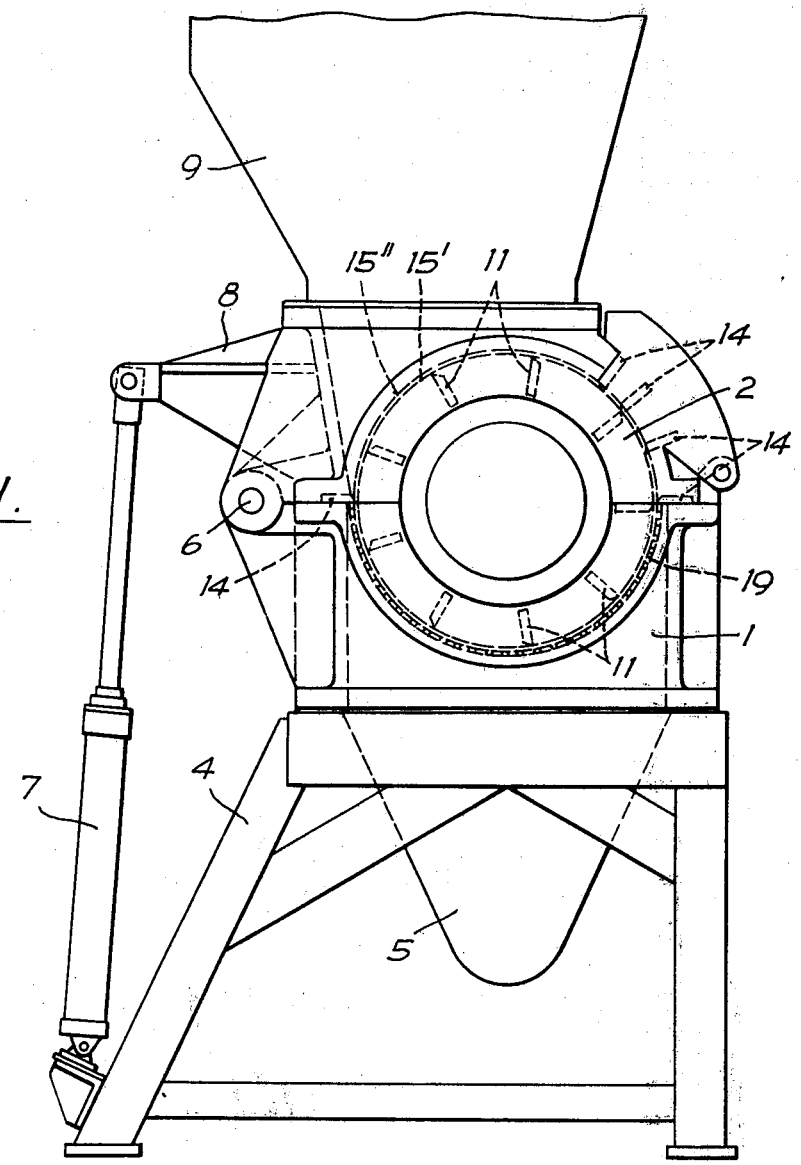
FIG. 1 shows a side view of an embodiment of the cutting mill of the invention in the operating position.

Referring now to the drawings, a cutting mill for fragmenting and separating solid matter, for example, synthetics, leather, wood and the like includes a housing which consists of a lower part 1 and an upper part 2. The housing forms a cylindrical cutting chamber 3 having a horizontal longitudinal axis. The lower part 1 is supported by a frame 4, which may have any suitable construction. A collecting vessel 5 is connected to the open lower side of the lower part 1, which collects the fragmented particles which have been correctly sized.

Figure 2:
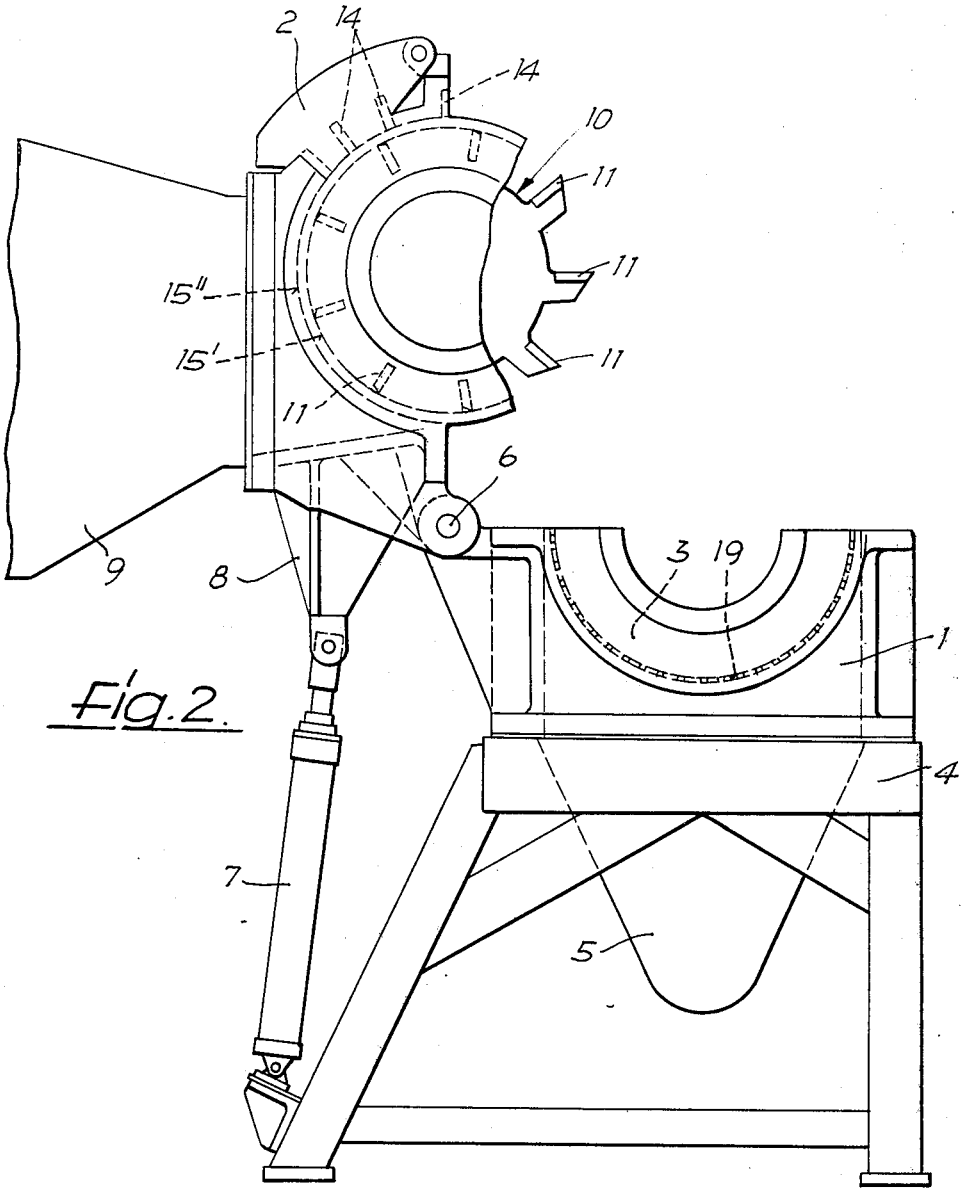
FIG. 2 shows a side view of the cutting mill of FIG. 1 with the upper housing part open.

At the rear side of the cutting mill which is remote from the front or operating side, the upper part of the housing 2 is mounted by hinges 6, the swivel axes of which are parallel to the longitudinal axis of the cutting chamber 3 and, in the example, are located at the interface between the lower part 1 and the upper part 2. The hinges 6 connect the upper part 2 in a pivotable manner with the lower part 1. When the upper part 2 is swung away toward the rear, as shown in FIG. 2, that part of the cutting chamber 3 which is formed by the lower part 1 is, therefore, freely accessible from the front and from the sides. A cylinder-piston assembly 7 is pivotably connected at one end to the frame 4 and at its other end to the arm 8 of the upper part 2 which extends toward the rear. The assembly 7 pivots the upper part 2 from the closed or operating position shown in FIG. 1 to the open position shown in FIG. 2, and vice versa.

On its upper side, the upper part 2 has an inlet opening upon which a funnel tube 9 or any suitably constructed feeder chute is mounted.

A rotor, designated generally by reference numeral 10, mounted in the upper part 2, in such a way that its axis of rotation coincides with the longitudinal axis of the cutting chamber 3. When the upper part is swung away toward the rear, the rotor 10 is also, as shown in FIG. 2, lifted out of the lower part and moved to the rear.

The rotor 10 is provided with blades 11, the cutting edges of which are located in a cylindrical surface concentric to the axis of rotation of the rotor. The adjustment of the blades 11 to their circumference of flight is accomplished in a known manner by means of adjustable mounting elements (not shown) which permit a previous adjustment of the blades 11 before their installation into the rotor 10. During the installation into the rotor, the adjustable mounting elements must then only be brought in contact with a stop surface or a stop edge.

Figure 3:
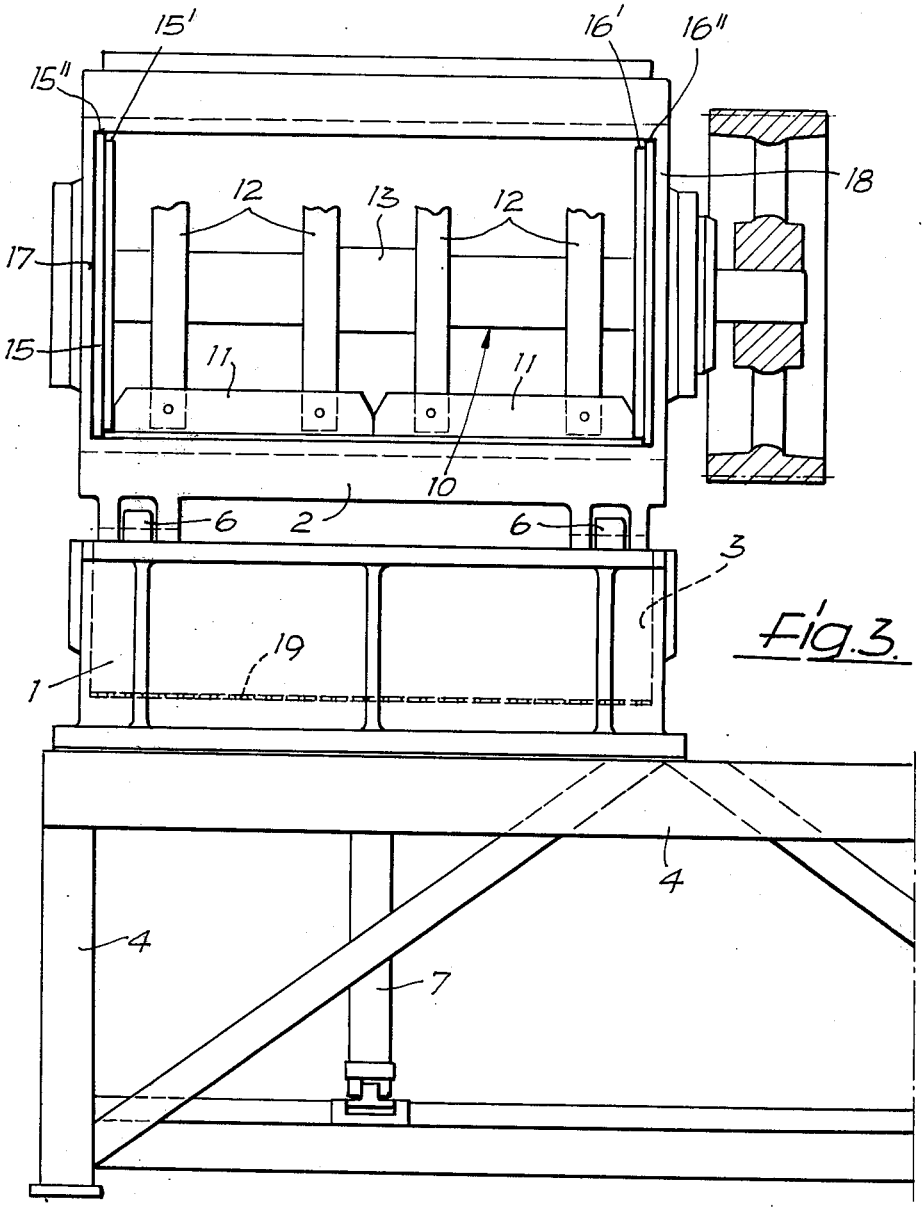
FIG. 3 shows a front view partly in section of the cutting mill of FIG. 2.
Figure 4:
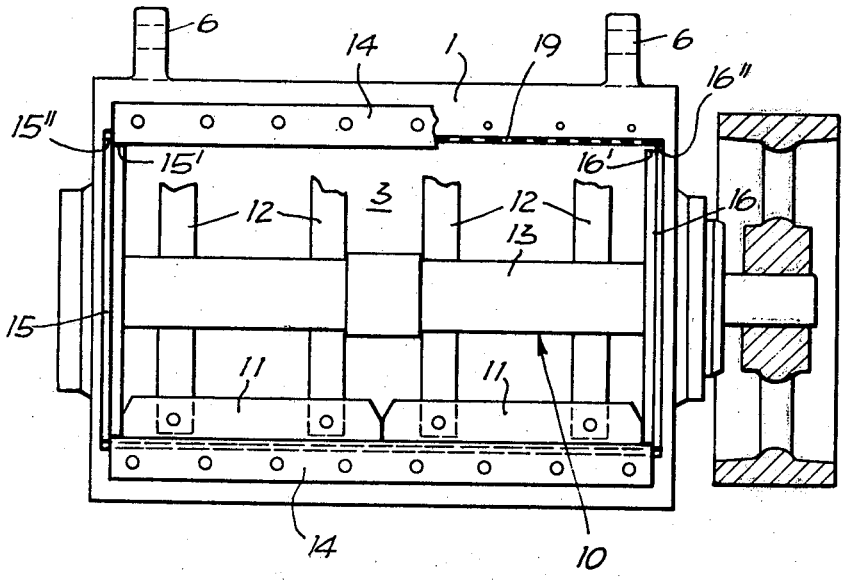
FIG. 4 shows a broken top view of the housing with the rotor in the operating position.

In the embodiment shown, the rotor is equipped with nine blades 11. A different number of blades may, however, also be advantageously utilized. Also, in the example, the blades 11 only extend over half the length of the rotor, so that, as shown in FIGS. 3 and 4, the cutting blades 11 are arranged in pairs to provide a blade which extends over the entire length of the rotor. The blades 11 are secured by holders 12, which are mounted on the shaft 13 of the rotor 10.

Stator blades 14 are provided to interact with the rotor blades 11. The stator blades 14 are located in the upper part 2 and can be adjusted in the circumferential direction of the cutting chamber in connection with the inlet opening therein. The adjustment is carried out by means of two circular plates 15 and 16, which are arranged with only a small gap adjacent to one or the other of the rotor ends defined by the ends of the blades 11 and concentrically of the longitudinal axis of the rotor. The peripheries of the plates are spaced radially of the shaft 13. In order to insure a concentric arrangement to the longitudinal axis of the rotor or the shaft 13, the plates 15 and 16 are each located on a collar of the two side walls 17 and 18 of the upper part 2 which is concentric to the boring of the shaft bearing.

The two identically constructed plates 15 and 16 have sections with different diameters in which case the section with the larger diameter is located on the side confronting its respective housing side wall and the section with the smaller diameter is located on the side confronting the blades.

The surface of the section with the smaller diameter which is concentric to the axis of rotation of the rotor forms a stop face 15' or 16' for the cutting edges of the stator blades. As shown in FIG. 4, the stator blades 14, for a correct adjustment in relation to the blades 11 need only have their extreme ends brought into contact with the stop surfaces 15' and 16' and be screwed tightly in this position. When worn blades are removed for resharpening, the adjustment of the stator blades is accomplished in the same manner as above.

The larger surface of the section of the two plates 15 and 16 is also concentric to the axis of rotation of the rotor 10 and is formed by a stop surface 15" and 16" each for a sieve 19 in the form of a cylindrically bent orifice plate which is inserted into the lower part 1 and forms the lower surface of the cutting chamber 3. The lower housing part includes bearing surfaces upon which the sieve bears, such bearing surfaces being aligned transversely of the rotor axis with the stop surfaces of the plates 15 and 16. Since the gap between the sieve 19 and the blades 11 is only dependent on the diameter of the plates 15 and 16 in the range of the larger contact surfaces 15″ or 16″, the correct gap size is obtained automatically, when the sieve 19 is in contact with the contact surfaces 15″ and 16″. In order to insure such a contact, the lower part 1 is provided with bearing surfaces aligned with the contact surfaces 15″ and 16″ between which bearing surfaces and the contact surfaces 15″ and 16″ the sieve 19 is clamped, when the upper part 2 and the lower part 1 are pivoted together and clamped by means of screws (not shown). In the operating position, the rotor 10 is thus positioned by the bearing surfaces for the sieve 19 and the contact surfaces 15″ and 16″. Manufacturing inaccuracies, for example, of the hinges are, therefore, not consequential to the adjustment of the stator blades 14 and the gap between the blades 11 and the sieve 19. In addition by means of the plates 15 and 16, the sieve 19 is secured in the lower part 1 in a particularly simple manner.

This arrangement is also advantageous for replacing the sieve, since it is loosely positioned in the lower part 1 when the upper part 2, together with the rotor 10, is swung upwardly and toward the rear.

The free access to the sieve 19 with the upper part 2 swung back, however, is not only advantageous for an exchange of sieves, but as previously mentioned also facilitates cleaning of the cutting chamber 3.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A cutting mill comprising a housing having upper and lower parts forming a cutting chamber, a rotor rotatably mounted in the upper housing part on an axis, said rotor having cutting blades mounted thereon arranged in a cylindrical surface defining a circumference of flight of the rotor blades, stator cutting blades mounted in said housing and operatively cooperating with said rotor blades, a sieve removably mounted in the lower housing part, means pivotably mounting said upper and lower housing parts about an axis substantially parallel to the rotor axis, said upper and lower housing parts being pivotable relative to each other between an operating position and an open position, whereby, when said housing parts are relatively pivoted to the open position, the lower housing part is accessible for removal and replacement of the sieve and including spacing means mounted in the upper housing part for spacing the sieve a predetermined radial gap from the rotor blade circumference of flight when said upper and lower housing parts are pivoted to said operating position, said spacing means including arcuate stop surfaces extending radially beyond the circumference of flight of the rotor blades.

2. The cutting mill according to claim 1, wherein said spacing means include spacing elements provided with said stop surfaces for the sieve, said stop surfaces being concentric to the rotational axis of the rotor and extending radially beyond the circumference of flight of the rotor blades a distance substantially equivalent to said predetermined radial gap.

3. The cutting mill according to claim 2, wherein said spacing elements comprise plates and said stop surfaces are cylindrical surfaces.

4. The cutting mill according to claim 2, wherein a spacing element is positioned adjacent each end of the rotor and is at least indirectly connected to the rotor.

5. The cutting mill according to claim 4, wherein said spacing elements comprise lateral limiting walls of the cutting chamber.

6. The cutting mill according to claim 2, wherein said spacing elements include means for adjusting the stator blades radially of the rotor axis, said adjusting means including further stop surfaces arranged concentrically to the rotor axis.

7. The cutting mill according to claim 6, wherein said spacing elements are constructed as circular plates, said further stop surfaces comprising steps in the peripheral surfaces of said plates.

* * * * *